US010335844B2

(12) United States Patent
Perrot et al.

(10) Patent No.: US 10,335,844 B2
(45) Date of Patent: Jul. 2, 2019

(54) FOLDING DEVICE FOR FORMING A CORRUGATION IN A METAL SHEET AND METHOD FOR USING A FOLDING DEVICE

(71) Applicant: GAZTRANSPORT ET TECHNIGAZ, Saint Remy les Chevreuse (FR)

(72) Inventors: Olivier Perrot, Etampes (FR); Mohamed Sassi, Meudon-la-foret (FR); Charles Gimbert, Boulogne Billancourt (FR); Thomas Conejero, Guyancourt (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 425 days.

(21) Appl. No.: 15/308,424

(22) PCT Filed: May 6, 2015

(86) PCT No.: PCT/FR2015/051203
§ 371 (c)(1),
(2) Date: Nov. 2, 2016

(87) PCT Pub. No.: WO2015/170054
PCT Pub. Date: Nov. 12, 2015

(65) Prior Publication Data

US 2017/0066027 A1 Mar. 9, 2017

(30) Foreign Application Priority Data

May 6, 2014 (FR) ..... 14 54078

(51) Int. Cl.
*B21D 13/02* (2006.01)
*B21D 3/00* (2006.01)

(52) U.S. Cl.
CPC ..... *B21D 13/02* (2013.01); *B21D 3/00* (2013.01)

(58) Field of Classification Search
CPC ..... B21D 13/02; B21D 31/00
(Continued)

(56) References Cited

U.S. PATENT DOCUMENTS 1,997,122 A * 4/1935 Rogers ..... B21D 13/02 72/396
3,686,920 A 8/1972 Alleaume et al.
(Continued)

FOREIGN PATENT DOCUMENTS

DE 434650 C 9/1926
FR 2861030 A1 4/2005
(Continued)

*Primary Examiner* — David B Jones
(74) *Attorney, Agent, or Firm* — Notaro, Michalos & Zaccaria P.C.

(57) ABSTRACT

A bending device for forming a corrugation in a metal sheet, the bending device having a frame, a die having two die elements, each having a concave half-impression, mounted able to slide on the frame; a punch having a head able to engage inside the impression of the die so as to press the metal sheet; and two side clamps mounted sliding and able to move vertically with respect to the lower frame so as to clamp the metal sheet against the bearing surfaces of the die elements. During the displacement of the punch into its bending position, the metal sheet transmits a traction force to the die elements and to the side clamps so as to displace them into their near position.

18 Claims, 8 Drawing Sheets

(58) Field of Classification Search
USPC ..... 72/309
See application file for complete search history.

(56) References Cited

U.S. PATENT DOCUMENTS

| | | | | | |
|---|---|---|---|---|---|
| 4,603,572 | A * | 8/1986 | Van Breukelen | ..... | B21D 11/08<br>72/385 |
| 4,635,462 | A | 1/1987 | Bald et al. | | |
| 5,200,013 | A * | 4/1993 | Traber | ..... | B21D 13/02<br>156/210 |

FOREIGN PATENT DOCUMENTS

| | | | |
|---|---|---|---|
| FR | 2968284 | A1 | 6/2012 |
| KR | 100552898 | B1 | 2/2006 |
| KR | 20080090107 | A | 10/2008 |

* cited by examiner

FOLDING DEVICE FOR FORMING A CORRUGATION IN A METAL SHEET AND METHOD FOR USING A FOLDING DEVICE

TECHNICAL FIELD

The invention relates to a bending device for forming a corrugation in sheet metal intended for the construction of a tight membrane of a fluid storage tank.

The invention refers in particular to the field of tanks, airtight and thermally insulated, of membrane type, for the storage and/or transport of fluid, such as a cryogenic fluid.

PRIOR ART

In the prior art, corrugated sealing membranes are known, designed to form an internal lining for liquefied natural gas storage tanks. The sealing membrane is comprised of a plurality of metal plates, presenting series of perpendicular corrugations allowing it to become deformed under the force of thermal and mechanical stresses generated by the fluid kept in the tank.

One such corrugated sealing membrane is described in particular in document FR2861030. The corrugated membrane comprises a first series of parallel corrugations, or high corrugations, extending in one direction y, and a second series of parallel corrugations, or low corrugations, extending in a direction x perpendicular to direction y.

Document KR1020080090107 describes a bending device to form a corrugation in such a sealing membrane. The bending device, represented in FIGS. 6a to 6c of the cited document, comprises a die having two die elements each presenting a half-impression, able to move between a far position and a close position. When the two die elements are brought one against the other, the half-impressions together form an impression corresponding to the shape of the corrugation being formed. Moreover, the device comprises a punch able to move between a position of rest and a bending position in which the punch is engaged inside the impression in order to shape the corrugation. The bending device likewise comprises two side clamps, extending on either side of the punch and cooperating respectively with one or the other of the die elements. The side clamps make it possible to hold the metal sheet against the die elements in order to ensure that it remains in position during its bending.

The die elements and the side clamps are moved by actuating means commanded by a control unit. During a bending operation, the two die elements and the two side clamps come together in a manner simultaneous with the displacement of the punch toward its bending position. The movements of the die elements and the side clamps are precisely synchronized with the movement of the punch so that there is no modification of the thickness of the metal sheet during its bending. It is in fact essential that the metal sheet after the bending has a constant thickness so as not to degrade its mechanical properties.

This need for synchronization of the movements requires, on the one hand, that the device be regulated in precise manner and, on the other hand, that the control of the movements be perfectly realized. In fact, any lack of synchronism causes in the corrugation either a decrease in thickness of the metal sheet or a buildup of material and, consequently, unwanted wrinkles in the metal sheet.

SUMMARY

One idea forming the basis of the invention is to propose a bending device to form a corrugation in a metal sheet intended for the construction of an airtight membrane of a storage tank which is simple and which makes it possible to obtain a corrugation without modification of the thickness of the sheet.

According to one embodiment, the invention provides a bending device for forming a corrugation in a metal sheet intended for the construction of an airtight membrane of a fluid storage tank, the bending device comprising:

- a lower frame;
- a lower die having a first and a second die element, each having a bearing surface for the metal sheet and a concave half-impression, the first and second die elements each being mounted so as to slide on the lower frame in a direction x, so as to be able to slide between a far position and a near position, the half-impressions of the first and second die elements together defining an impression corresponding to the shape of the corrugation being formed when the first and second die elements are in their near position, said first and second die elements being returned to their far position by a first return unit;
- an upper punch, arranged above the lower die, comprising a lower end provided with a head having a shape complementary to that of the impression, said upper punch being able to move vertically with respect to the lower frame between a position of rest and a bending position in which the head of said upper punch is engaged inside the impression of the lower die so as to press on the metal sheet; and
- a first and a second side clamp, extending on either side of the upper punch, above the lower die, respectively facing the first and the second die elements, said first and second side clamps being mounted able to slide in the direction x between a near position and a far position and being returned to their far position by a second return unit; the first and the second side clamps being able to move vertically with respect to the lower frame between a released position and a clamping position in which the first and the second side clamps are respectively brought near the bearing surface of the first die element and that of the second die element so as to clamp the metal sheet against the bearing surface of the first and the second die elements so that, during operation, when the metal sheet is clamped between the side clamps and the die elements, the displacement of the upper punch from its position of rest toward its bending position causes a bending of the metal sheet, during which the metal sheet transmits a traction force in the direction x to the die elements and to the side clamps and thus displaces the die elements and the side clamps into their near position.

Thus, the metal sheets produced thanks to such a bending device have a constant thickness in the area of their corrugation because the displacement of the die elements and side clamps is at least in part provided by traction forces exerted by the metal sheet during its deformation by the punch, which means a synchronization of the movements of the die elements and side clamps with that of the punch.

According to its embodiments, such a bending device may comprise one or more of the following characteristics:

- the bending device is designed to form a corrugation in a metal sheet having a preformed corrugation extending in a direction perpendicular to the corrugation being formed;
- the first and the second die elements each comprising a V-shaped groove designed to receive said preformed corrugation.

the side clamps each comprise a male element, projecting in the direction of the lower frame, having a V shape which is able to be introduced into the groove of the die element facing it when the side clamps are in their clamping position.

the head of the punch comprises a finger projecting from the head in the direction of the lower frame and disposed facing the zone of intersection between the impression and the grooves of the first and second die elements.

the bending device comprises two knives, designed for the deformation of the preformed corrugation, on either side of the junction between the preformed corrugation and the corrugation being formed, the two knives being disposed on either side of the zone of intersection between the impression and the grooves of the first and second die elements; said knives being mounted so as to slide on the lower frame in the direction x between a far position and a near position and being returned to their far position by a third return unit, said knives being furthermore mounted able to move vertically in relation to the lower frame between a low position of rest and a high bending position in which they are able to deform the preformed corrugation, the device furthermore comprising a driving mechanism of the knives, which is arranged to move the knives into their high bending position during the displacement of the punch into its bending position.

the driving mechanism of the knives comprises a movable support unit of the knives, able to move vertically on the lower frame, and two levers which are each hinged to the lower frame; the levers each comprising:

a first end provided with a bearing surface, extending inside the impression of the lower die and able to cooperate, during operation, with a portion of the metal sheet intended to be bent to form the corrugation, such that the lever pivots when the punch moves into its bending position; and a second end cooperating with the movable support unit of the knives so that the movable support unit of the knives is moved upward when the lever pivots by virtue of a movement of the upper punch into its bending position.

the knives are each borne by a carriage able to slide on a respective guide rail and said guide rails are borne by the movable support unit of the knives.

the bending device comprises an upper plunger, able to move vertically with respect to the lower frame; the upper punch being borne by the upper plunger; the first and second side clamps being able to slide vertically on respectively a first and a second support plate; said first and second support plates being able to slide in the direction x on the upper plunger so as to allow the movement of the side clamps between their near position and their far position; each side clamp being furthermore moved back from its respective support plate by return units.

the return units exerting a return force between each side clamp and its respective support plate are springs, gas jacks, hydraulic jacks, or pneumatic jacks.

the lower die has a recess extending in a direction perpendicular to the corrugation being formed, the recess extending along one edge of the bearing surface and one edge of the half-impression of each of the first and second die elements and the upper punch, the first and the second side clamps each having an edge provided with a projecting portion, disposed above said recess, complementary in shape to said recess and designed to engage in said recess during the movement of the punch into its bending position and of the side clamps into their clamping position so as to form a joggling along one edge of the metal sheet perpendicular to the corrugation being formed.

the lower die has a recess extending in a direction parallel to the corrugation being formed, the recess extending along one edge of the bearing surface of one of the first and second die elements and one of the first and second side clamps has a projecting portion, disposed above said recess, complementary in shape to said recess and designed to engage in said recess during the movement of the side clamps into their clamping position so as to form a joggling along one edge of the metal sheet parallel to the corrugation being formed.

the bending device moreover comprises means of assisting the movement of the first and second die elements and the first and second side clamps into their near position.

according to one embodiment, the means of assistance comprise two jacks cooperating respectively with one and the other of the first and second die elements or with the one and the other of the first and second side clamps and being designed to assist the movement of the die elements and the side clamps into their near position during the movement of the upper punch from its position of rest into its bending position.

the embodiment in which the jacks cooperate with the first and second die elements is preferred to the embodiment in which the jacks cooperate with the first and second side clamps in that it allows a direct action of the jacks on the elements participating in the bending of the sheet so that the assisting effect of the jacks is optimal.

according to one embodiment, the means of assistance comprise two pairs of jacks, each of the pairs of jacks cooperating with one or the other of the first and second die elements, the two jacks of each of the pairs being respectively disposed on either side of a vertical plane passing through the V-shaped groove of said die element.

the means of assistance comprise a first and a second cam follower borne respectively by the one and the other of the first and second die elements and respectively able to cooperate with a first and a second cam surface integrated with the upper punch; the first and the second cam followers and the first and the second cam surfaces being arranged so that during the movement of the upper punch from its position of rest into its bending position the first and the second cam followers cooperate respectively with the first and the second cam surfaces to assist the movement of the die elements and the side clamps into their near position.

According to one embodiment, the invention also provides a bending layout comprising a plurality of aforementioned bending devices.

According to one embodiment, the invention also provides a method of using a bending device to form a corrugation in a metal sheet intended for the construction of an airtight membrane of a fluid storage tank, the bending device comprising:

a lower frame;

a lower die having a first and a second die element, each having a bearing surface for the metal sheet and a concave half-impression, the first and second die elements each being mounted so as to slide on the lower frame in a direction x, so as to be able to slide between a far position and a near position, the half-impressions of the first and second die elements together defining an impression corresponding to the shape of the corrugation being formed when the first and second die elements are in their near position, said first and second die elements being returned to their far position by a first return unit;

an upper punch, arranged above the lower die, comprising a lower end provided with a head having a shape complementary to that of the impression, said upper punch being able to move vertically with respect to the lower frame between a position of rest and a bending position in which the head of said upper punch is engaged inside the impression of the lower die so as to press on the metal sheet; and a first and a second side clamp, extending on either side of the upper punch, above the lower die, respectively facing the first and the second die elements, said first and second side clamps being mounted able to slide in the direction x between a near position and a far position and being returned to their far position by a second return unit; the first and the second side clamps being able to move vertically with respect to the lower frame between a released position and a clamping position in which the first and the second side clamps are respectively brought near the bearing surface of the first die element and that of the second die element so as to clamp the metal sheet against the bearing surface of the first and the second die elements;

said method involving:

the positioning of a metal sheet to bear against the bearing surfaces of the first and second die elements;

the movement of the first and second side clamps into their clamping position in which the first and the second side clamps force the metal sheet respectively against the bearing surface of the first die element and the second die element;

the movement of the upper punch into its bending position in which the head of the upper punch presses the metal sheet inside the impression of the lower die so as to form a corrugation, said movement of the upper punch from its position of rest into its bending position resulting in a bending of the metal sheet such that the metal sheet transmits a traction force in the direction x to the die elements and to the side clamps and thus moves the die elements and the side clamps into their near position.

According to its embodiments, such a method may involve one or more of the following characteristics:

the metal sheet being bent has a preformed corrugation and the first and the second die elements each comprise a V-shaped groove; during the positioning of the metal sheet against the bearing surfaces of the first and second die elements, the preformed corrugation being engaged inside the grooves.

the bending device comprises two knives, designed for the deformation of the preformed corrugation, on either side of the junction between the preformed corrugation and the corrugation being formed, the two knives being disposed on either side of the zone of intersection between the impression and the grooves of the first and second die elements; said knives being mounted so as to slide on the lower frame in the direction x between a far position and a near position and being returned to their far position by a third return unit, said knives being furthermore mounted able to move vertically in relation to the lower frame between a low position of rest and a high bending position in which they are able to deform the preformed corrugation, the device furthermore comprising a driving mechanism of the knives, which is arranged to move the knives into their high bending position during the displacement of the punch into its bending position; the displacement of the upper punch into its bending position producing, on the one hand, a displacement of the knives into their high bending position and, on the other hand, a bending of the metal sheet such that the metal sheet transmits a traction force in the direction x to the knives and thus moves the knives into their near position.

BRIEF DESCRIPTION OF THE FIGURES

The invention will be better comprehended, and other goals, details, characteristics and advantages thereof will appear more clearly in the course of the following description of several particular embodiments of the invention, given solely for illustration, and not being limiting, with reference to the enclosed drawings.

DETAILED DESCRIPTION OF EMBODIMENTS

Figure 1:
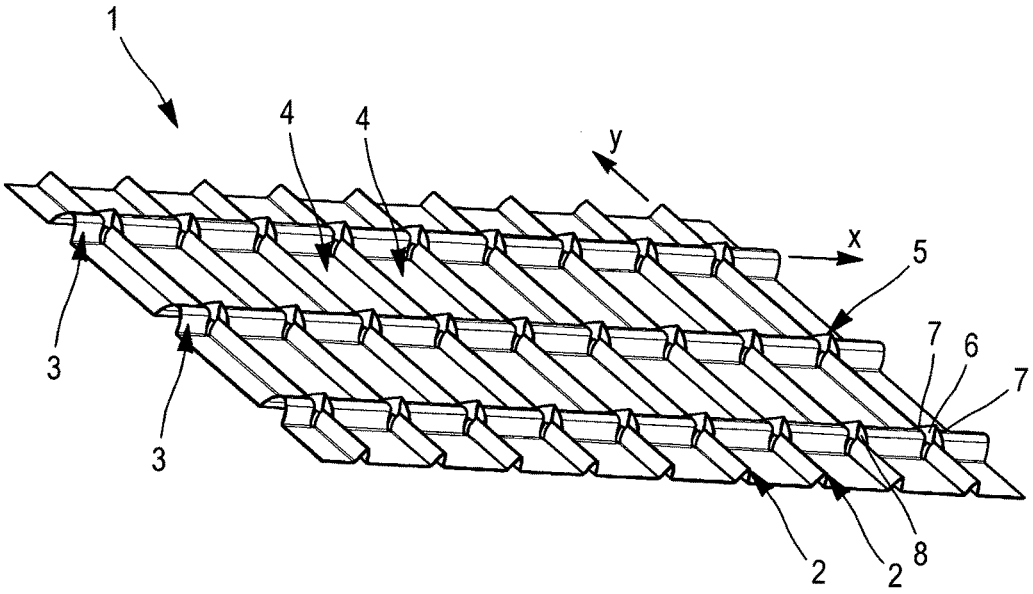
FIG. 1 is a view of a corrugated metal sheet intended for the construction of an airtight membrane of a liquefied natural gas storage tank.

FIG. 1 illustrates a corrugated metal plate 1 to be used for the formation of an airtight membrane of a liquefied natural gas storage tank.

The metal plate 1 has a first series of parallel corrugations 2, so-called low corrugations, extending in a direction y, and a second series of parallel corrugations 3, so-called high corrugations, extending in a direction x. The directions x and y of the series of corrugations are perpendicular. The corrugations 2, 3 are projecting from the internal surface of the metal plate 1, which is designed to be placed in contact with the fluid contained in the tank. The edges of the metal plate 1 here are parallel to the corrugations 2, 3. We note that the terms "high" and "low" have a relative meaning and mean that the so-called low corrugations 2 have a lesser height than the so-called high corrugations 3.

The metal plate 1 has a plurality of planar surfaces 4 between the corrugations 2, 3. In the area of each junction between a low corrugation 2 and a high corrugation 3 the metal plate 1 has a node zone 5. The node zone 5 comprises a central portion 6 having a peak projecting toward the interior of the tank. Moreover, the central portion 6 is bordered, on the one hand, by a pair of concave corrugations 7 formed in the ridge of the high corrugation 3 and, on the other hand, by a pair of recesses 8 into which the low corrugation 2 penetrates.

The corrugations 2, 3 of the metal plate 1 allow the airtight membrane to be flexible so that it can become deformed under the effect of thermal and mechanical stresses generated by the liquefied natural gas stored in the tank.

The metal sheet 1 in particular can be made of stainless steel, aluminum, Invar®: which is an alloy of iron and nickel whose coefficient of expansion is typically between $1.2\times10^{-6}$ and $2\times10^{-6}$ $K^{-1}$, or an iron alloy with a high content of manganese whose coefficient of expansion is typically of the order of $7\times10^{-6}$ $K^{-1}$. However, other metals or alloys are also possible.

As an example, the metal sheet 1 has a thickness of around 1.2 mm. Other thicknesses are also conceivable, knowing that a thickening of the metal sheet 1 results in an increased cost and generally increases the rigidity of the corrugations 2, 3.

According to one advantageous embodiment, not shown, two perpendicular edges of each metal sheet 1 have a joggling, that is, an area of height difference, such that when the metal plates are welded together the edges having a joggling will each rise above the opposite edge of the adjacent metal sheet.

FIGS. 2 to 8 and 10 show a bending device allowing the forming of a low corrugation as well as the node between this low corrugation and a high corrugation in a metal sheet where a high corrugation has been previously formed.

Figure 2:
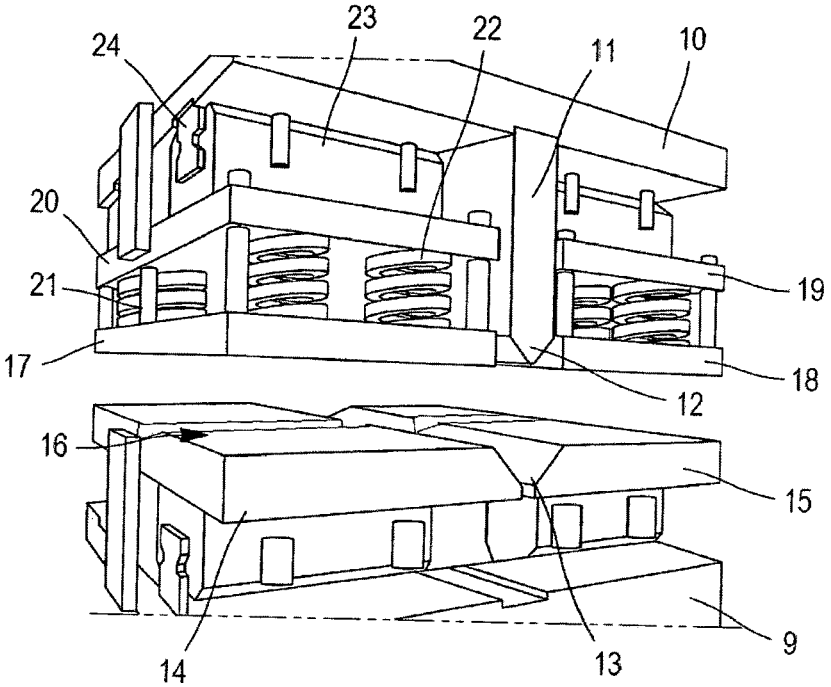
FIG. 2 is a perspective view of a bending device to form a corrugation in a metal sheet.

Referring to FIG. 2, one notices that the bending device has a fixed lower frame 9 and an upper plunger 10 which can move vertically with respect to the lower frame 9. The device has a punch 11, borne by the upper plunger 10, and having at its lower end a head 12 with a shape corresponding to the shape of the corrugation being fashioned. The head 12 has a V-shaped cross section which extends for the entire length of the corrugation being formed. The head 12 of the plunger is designed to engage, in the bending position, inside an impression 13, of complementary shape, formed in a lower die borne by the lower frame 9. The upper plunger 10 should be able to exert a pressure of the order of 5 tons at the node zone being formed. Thus, one could use a press able to exert a pressure of the order of 30 tons to make three nodes, while the presses used in the prior art quite often need to have a much larger capacity, of the order of 150 to 200 tons.

The lower die is composed of two die elements 14, 15 which are mounted to slide horizontally on the lower frame 9 in a direction perpendicular to the direction of the corrugation being formed, between a far position and a near position. The die elements 14, 15 have an upper bearing surface 16 for the metal sheet. Each die element 14, 15 furthermore has, in the area of its edge facing the other die element 14, 15, a concave half-impression. Thus, when the two die elements 14, 15 are in a near position, the half-impressions together form the impression 13 corresponding to the shape of the corrugation being made. Return units, not shown in FIG. 2, assure a returning of the two die elements 14, 15 to their far position.

Moreover, the plunger 10 likewise carries two side clamps 17, 18 extending on either side of the punch 11. Each side clamp 17, 18 is disposed to face a respective die element 14, 15. The side clamps 17, 18 being borne by the plunger 10, they are able to be displaced between a position of rest and a clamping position in which they apply the metal sheet against the bearing surface 16 of the die elements 14, 15 when the plunger 10 is moved toward the lower frame 9.

The side clamps 17, 18 are mounted so as to move vertically in relation to the plunger 10. In the embodiment shown, each side clamp 17, 18 is mounted so that it can slide vertically on a support plate 19, 20 via a guiding device comprising a plurality of guide tubes 21 integrated with said side clamp 17, 18 and able to slide in bores devised in the support plate 19, 20. Springs 22 exert a return force between each support plate 19, 20 and the side clamp 17, 18 opposite it. Thus, the movements of the side clamps 17, 18 into their clamping position and of the punch 11 into its bending position can be provided simultaneously by the movement of the plunger 10. Moreover, the clamping force between the side clamps 17, 18 and the lower die is controlled by means of the springs 22. We note that, in an embodiment not represented, the springs 22 are replaced by gas jacks, also called gas springs, having one end fixed to a support plate 19, 20 and a second end fixed to the side clamp 17, 18 facing it. In an alternative, the springs 22 could also be replaced by hydraulic or pneumatic jacks.

The side clamps 17, 18 are likewise able to slide horizontally on the upper plunger 10 in a direction perpendicular to the longitudinal direction of the corrugation being formed. To do so, each support plate 19, 20 is integrated with carriages 23 which are able to slide on guide rails 24 borne by the upper plunger 10. In order to suppress any friction between the carriages 23 and the guide rails 24, the carriages 23 are advantageously rolling type carriages having a plurality of rolling bodies able to cooperate with races borne by the guide rail. The side clamps 17, 18 are thus able to slide on the upper plunger 10 between a far position and a near position. Furthermore, one or more return units, not represented, ensure a returning of the side clamps 17, 18 to their far position. As an example, the return units are springs having a first end bearing against a lateral surface of the punch 11 and a second end bearing against the movable carriage 23 or against the support plate 19, 20 facing it.

In FIGS. 3 to 8, the upper plunger 10 as well as the guiding and return means of the side clamps 17, 18 are not represented. Moreover, the side clamps 17, 18 are represented in a position of clamping of the metal plate against the bearing surfaces 16 of the die elements 14, 15. The die elements 14, 15 and the side clamps 17, 18 are shown in far position in FIGS. 3 and 5 to 8, and in near position in FIG. 4.

Figure 3:
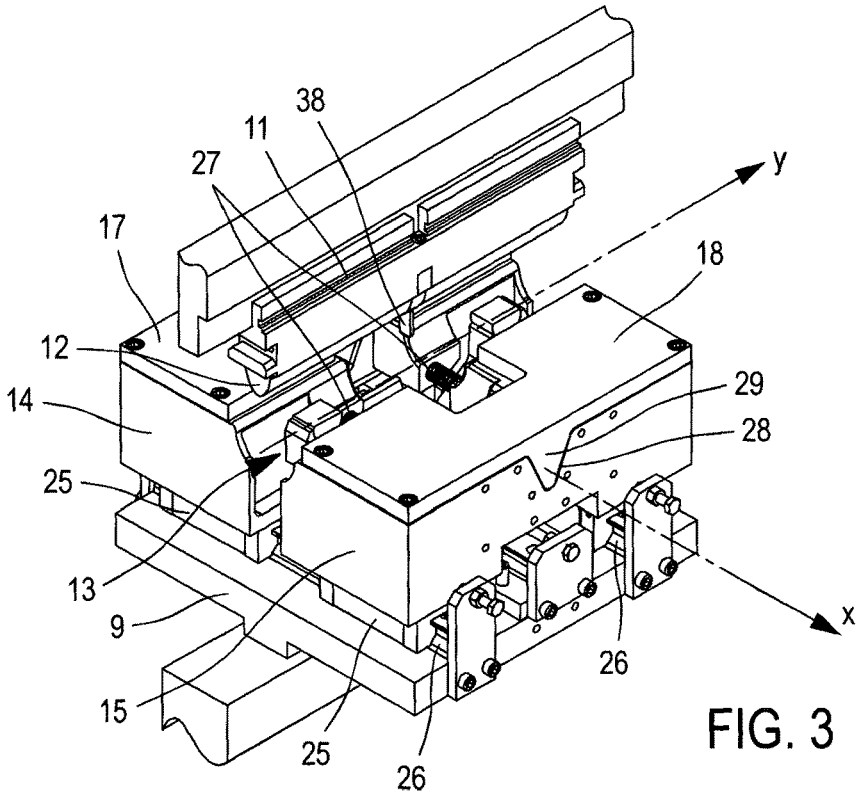
FIG. 3 is a partial perspective view of a bending device in which the punch is represented in its position of rest, the side clamps being in the position clamping the metal sheet against the die elements, the side clamps and the die elements being in their far position.
Figure 4:
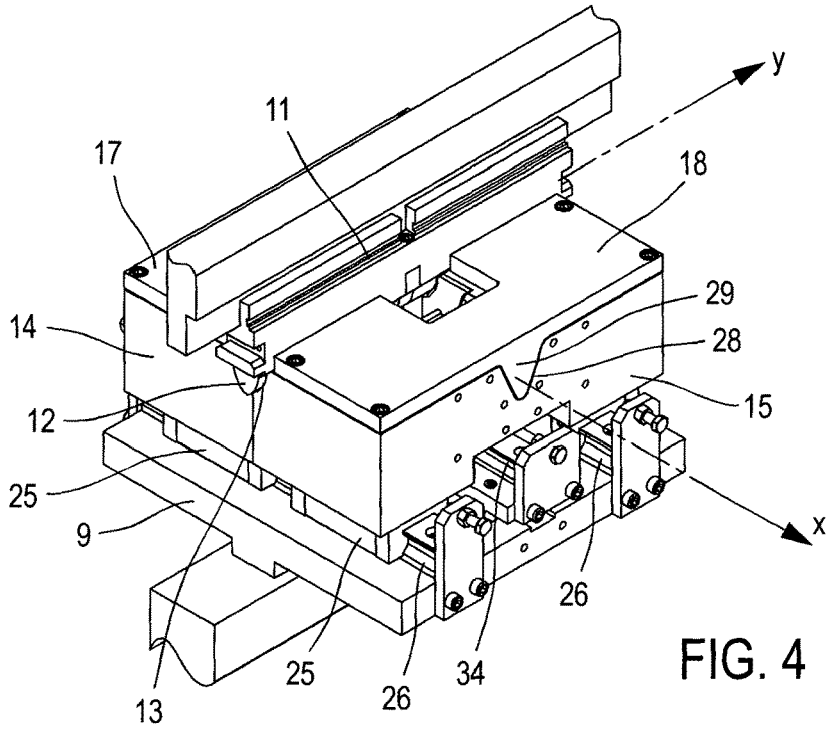
FIG. 4 is a partial perspective view of a bending device in which the punch is represented in its bending position, the side clamps and the die elements being moreover in their near position.

As represented in FIGS. 3 and 4, each die element 14, 15 is integrated with carriages 25 which are able to slide horizontally, in the direction x, on guide rails 26 borne by the lower frame 9. The carriages 25 are advantageously rolling type carriages having a plurality of rolling bodies able to cooperate with races borne by the guide rail 26. The return units, ensuring a return of the two die elements 14, 15 to their far position, are springs 27 in this case, represented in FIG. 3, and thrusting between the two die elements 14, 15.

Furthermore, one likewise notices in FIGS. 3 and 4 that the die elements 15, 16 each comprise a groove 28 extending in the direction x perpendicular to the direction y of the impression 13. The grooves 28 are designed to receive the high corrugation previously formed in the metal plate. The grooves 28 thus have a V-shaped cross section which is complementary in shape to that of the high corrugation. Likewise, the side clamps 17, 18 each comprise a projecting male element 29 directed toward the bottom, extending in the direction x and having a V shape complementary to that of the high corrugation.

Thus, during operation, when the side clamps 17, 18 are positioned in their clamping position, the preformed high corrugation is held between the male elements 29 of the side clamps 17, 18 and the grooves 28 of the die elements 15, 16. Thus, a clamping of the metal plate is likewise realized in the area of the preformed high corrugation during the shaping of a low corrugation.

Figure 6:
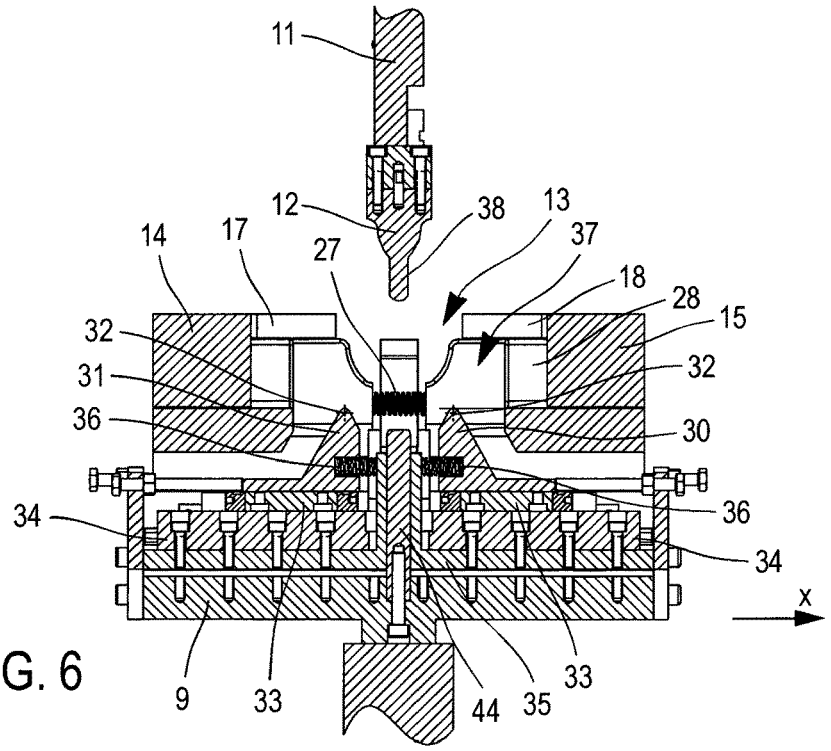
FIG. 6 is a sectional view in the plane VI-VI of the bending device of FIG. 5.

The head 12 of the punch 11 comprises a finger 38, represented in FIG. 6, projecting from the head 12 in the direction of the lower frame 9 and disposed opposite the zone of intersection between the half-impressions and the grooves 28 of the first and second die elements 14, 15. The finger 38 has the shape of a lamella which is able to deform the zone of intersection between the high corrugation and the low corrugation in order to produce a projecting peak. In one embodiment, not represented, the finger is vertically removable and able to be retracted once the deformation of the tip of the node has been commenced.

Figure 5:
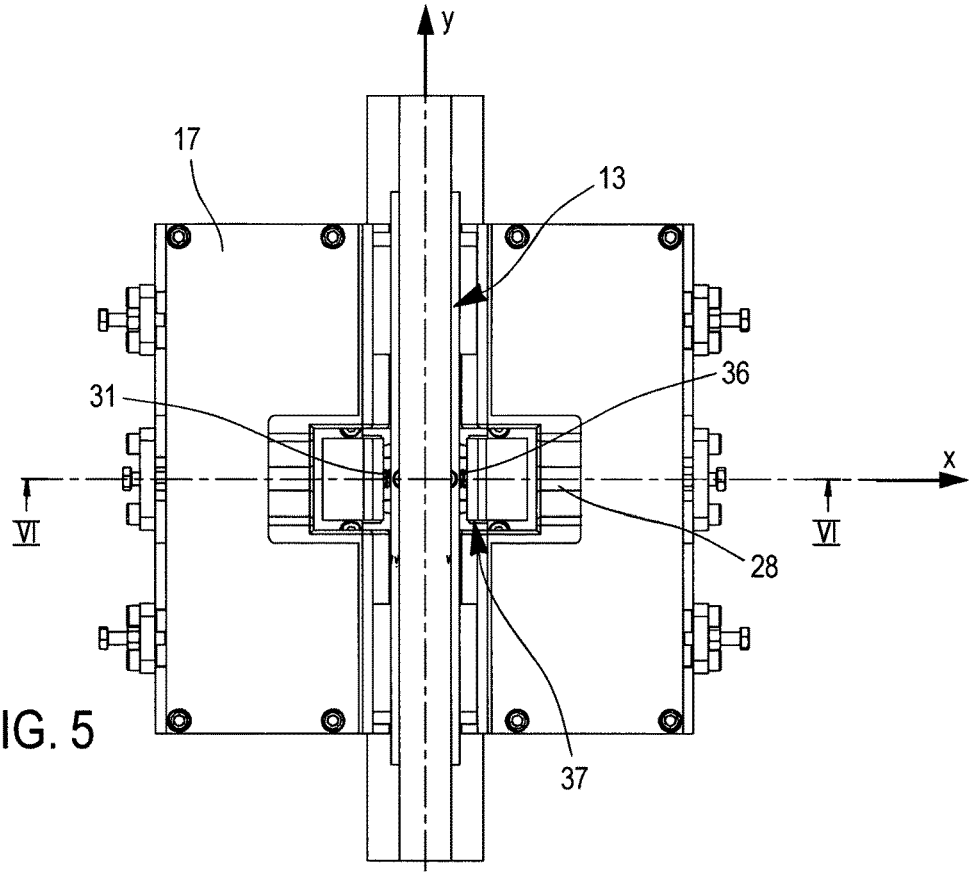
FIG. 5 is a top view of the bending device of FIG. 3 in which the side clamps and the die elements are in their far position.

Furthermore, the bending device is also outfitted with knives 30, 31, represented in FIGS. 5 and 6, making it possible to produce concave corrugations 7 in the ridge of the high corrugation of the metal plate on either side of the junction between the preformed high corrugation and the low corrugation being formed. The knives 30, 31 have an upwardly directed blade 32 and extend in parallel with the direction of the impression 13.

The knives 30, 31 are mounted able to slide on the lower frame 9 in the direction x of the grooves 28 between a far position and a near position. To accomplish this, the knives 30, 31 are each mounted on a carriage 33 able to slide on a guide rail 34. Furthermore, the guide rails 34 are borne by a support of the knives 35 which is able to move vertically with respect to the lower frame 9. The bending device is likewise outfitted with a drive mechanism, described below, which is able to move the support of the knives 35 upward so that said knives 30, 31 are moved into a high bending position when the punch 11 is moved downward in the direction of its bending position. Return units ensure a return of the knives 30, 31 to their far position. The return units here are springs 36 which act between the support of the knives 35 and said knives 30, 31.

In order for the knives 30, 31 to be able to deform the high corrugation on either side of the junction between the high corrugation and the low corrugation, the die elements 14, 15 each have an indentation 37 in the area of the intersection between their half-impression for producing the low corrugation and their groove 28 to accommodate the high corrugation.

Figure 7:
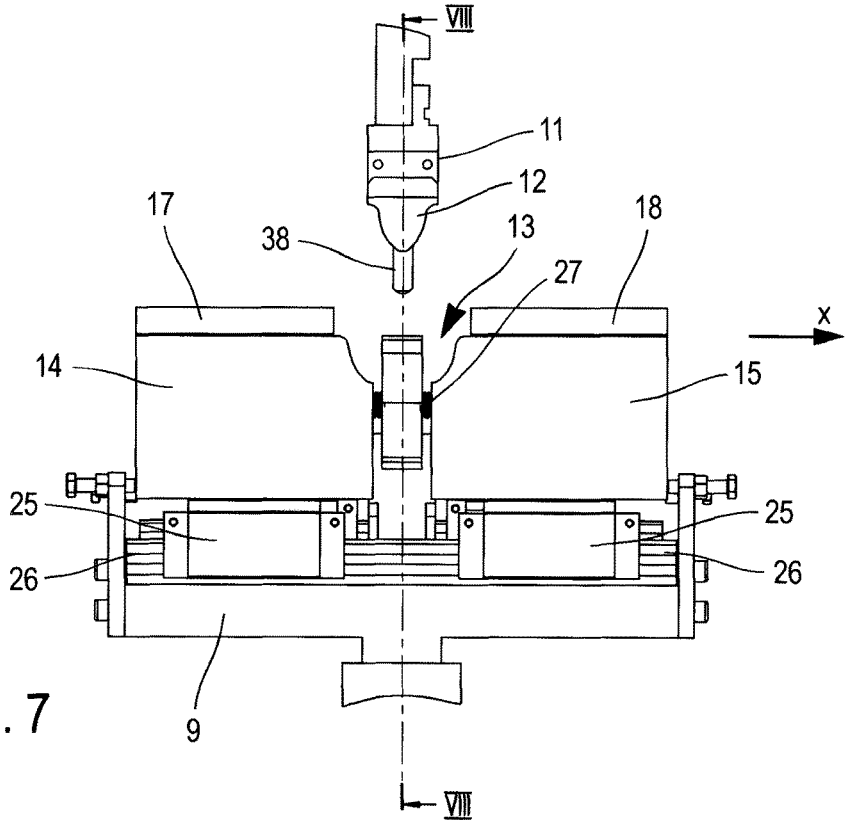
FIG. 7 is a front view of the bending device of FIG. 3 in which the side clamps and the die elements are in their far position.
Figure 8:
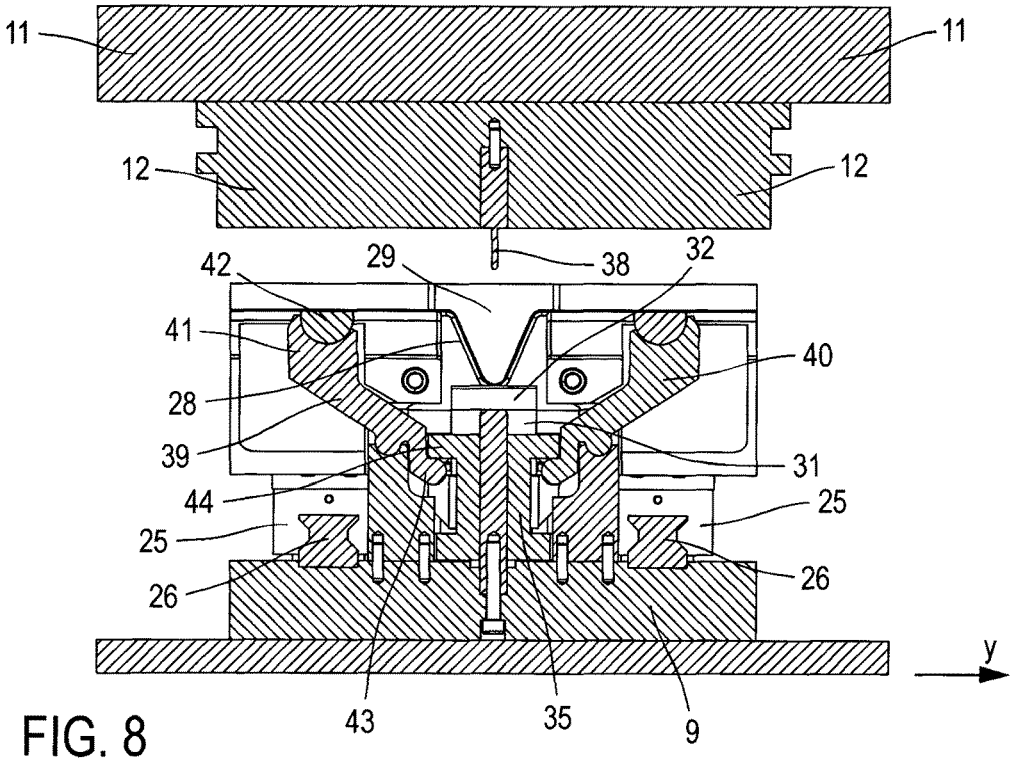
FIG. 8 is a sectional view in the plane VIII-VIII of the bending device of FIG. 7.
Figure 9:
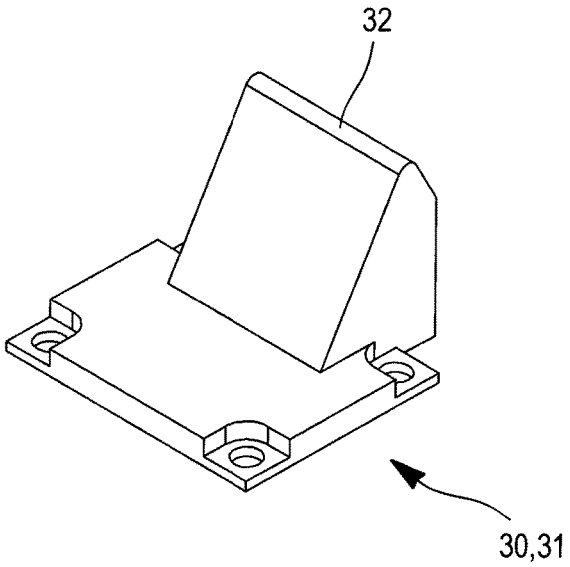
FIG. 9 is a perspective view of a knife designed for the deformation of a high corrugation on either side of a junction between a high corrugation and a low corrugation.

FIGS. 7 and 8 show the drive mechanism of the knives which is designed to move the support of the knives 35 upward when the punch 11 is driven into its bending position. The drive mechanism has two levers 39, 40. The levers 39, 40 are disposed in the space formed between the two die elements 14, 15. The levers 39, 40 are hinged to the upper frame 9 about an axis of rotation parallel to the direction x of the grooves 28.

The levers 39, 40 each comprise a first end 41 designed to cooperate, during operation, with a portion of the metal sheet which is going to be bent by the punch 11. Moreover, the levers 39, 40 comprise a second end 43 cooperating with the movable support of the knives 35 in order to move it upward. The first end 41 of the levers 39, 40 carries a contact piece 42 which, on the one hand, is hinged to the first end 41 of the levers 39, 40 and, on the other hand, comprises a planar support base, designed to cooperate with the metal sheet. Such an arrangement makes it possible to obtain a contact surface between the lever 39, 40 and the metal sheet which is essentially constant during the pivoting of the levers 39, 40. Furthermore, the second end 43 of the levers 39, 40 cooperates with a flange 44 borne by the support of the knives 35.

During operation, when the punch 11 makes contact with the portion of the metal sheet being bent, the punch 11 will exert a force on the first ends 42 of the levers 39, 40 that tends to make them pivot such that the second end 42 of the levers 39, 40 acts on the flange 44 of the support of the knives 35 and the knives 30, 31 are moved into their high bending position in which they deform the ridge of the high corrugation of the metal plate. When the bending of the corrugation is finished and the punch 11 has lifted again, the support of the knives 35 returns to its low position of rest under the effect of gravity.

One notices, in FIG. 6, that the support of the knives 35 is able to slide on the lower frame 9 by means of a guide tube 44 secured to the lower frame 9 and cooperating with a bore devised inside the support of the knives 35.

Furthermore, one likewise notices that the levers are symmetrical with respect to each other in regard to a vertical plane passing through the axis of the grooves 28. The levers 39, 40 thus pivot in opposite directions of rotation. Such an arrangement makes it possible to achieve a balanced drive mechanism for the knives.

The process for bending of a corrugated metal sheet shall now be described.

In a first step, the metal sheet is placed on the bearing surfaces 16 of the first and second die elements 14, 15. The metal sheet is positioned such that its preformed high corrugation is positioned inside the grooves 28 of the die elements 15, 16.

Next, the upper plunger 10 is moved downward in the direction of the lower frame 9. The side clamps 17, 18 are thus positioned in their clamping position in which they clamp the metal sheet against the bearing surfaces of the die elements (FIGS. 3 and 5 to 8). Then the springs 22 extending between the side clamps 17, 18 and the upper plunger 10 are compressed, while the plunger continues to descend and the punch 11 deforms the metal sheet.

The metal sheet being clamped between the side clamps 17, 18 and the die elements 14, 15, the metal sheet becoming deformed under the effect of the punch 11 exerts a traction force on the side clamps 17, 18 and the die elements 14, 15, against their return units 27, so as to move them into their near position (FIG. 4). Thus, the side clamps 17, 18 and the die elements 14, 15 are moved into their near position in a manner synchronized with the movement of the punch 11 and this without the need for a dedicated driving means.

Moreover, when the head 12 of the punch 11 engages inside the impression 13, the metal sheet also exerts a force on the levers 39, 40 actuating the knives 30, 31, which produces a movement of the knives 30, 31 into their high bending position. In parallel with this, the metal sheet as it is deformed exerts a traction force on the knives 30, 31, which tends to make them slide into their near position.

When the head 12 of the punch 11 has reached its extreme position, the upper plunger 10 can then be taken upward once more, moving away from the lower frame 9. Hence, the knives 30, 31, the die elements 14, 15 and the side clamps 17, 18 are automatically returned by their respective return units 27, 36 to their far position.

Figure 10:
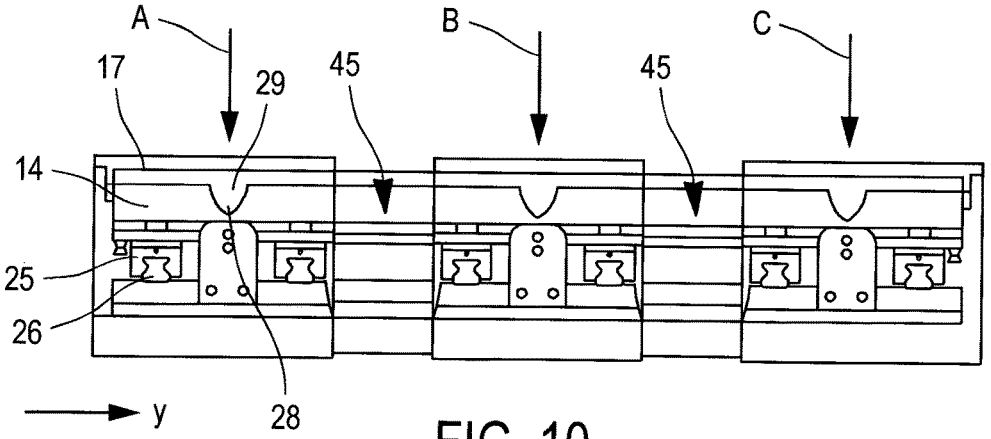
FIG. 10 is a lateral view of a bending layout comprising a plurality of bending devices as illustrated in FIGS. 2 to 8.

In relation to FIG. 10, there is shown a bending layout comprising a plurality of bending devices A, B, C as described above. In the embodiment shown, the bending layout is designed to form at least one corrugation in a metal sheet comprising three preformed high corrugations. Thus, to form this corrugation, one uses three devices A, B, C disposed one after the other in the direction y. Cross pieces 45 can be arranged between the different bending devices A, B, C. Thus, by changing the dimensions of said cross pieces 45, one can easily vary the pitch between the high corrugations.

Likewise, the bending layout can comprise several rows of bending devices A, B, C in order to shape several low corrugations in the same metal sheet, these rows being arranged one after the other in the direction x. We note, however, that it will be necessary to control the bending devices, sequentially, in such a bending layout so that the low corrugations are produced in succession.

Figure 11:
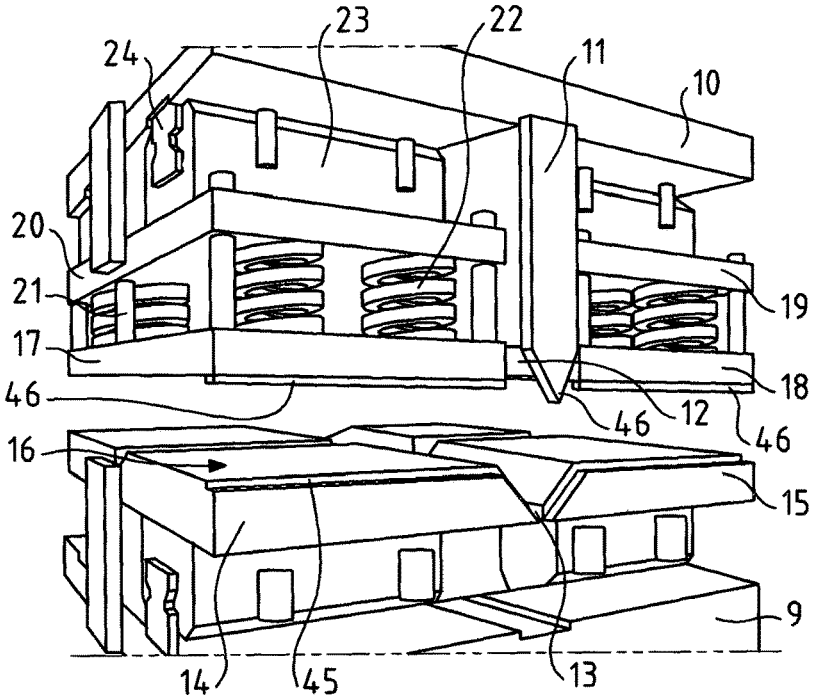
FIGS. 11, 12 and 13 are perspective views of bending devices according to three variant embodiments which furthermore allow the forming of a joggling in one or two edges of the metal sheet.
Figure 12:
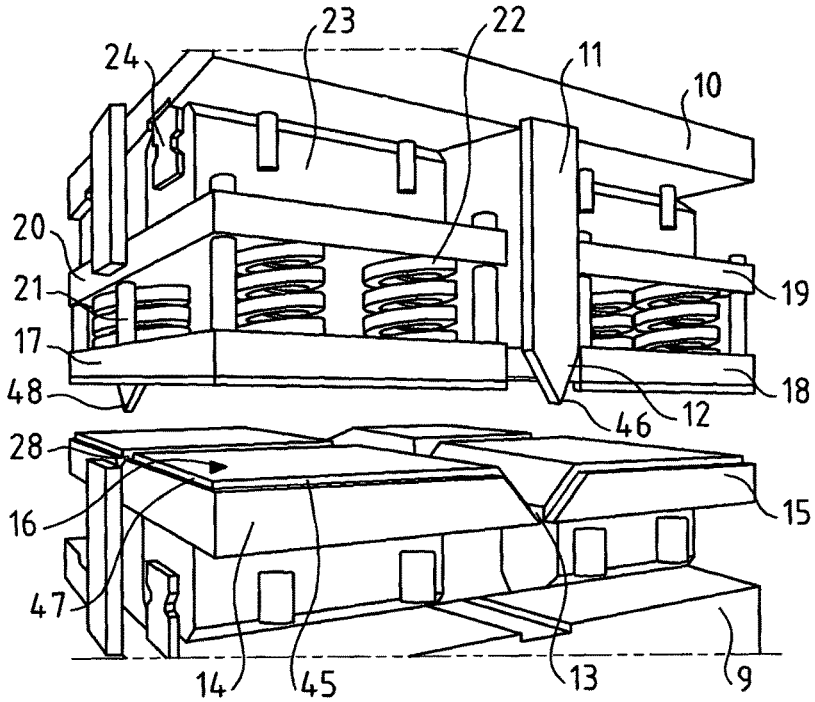
Figure 13:
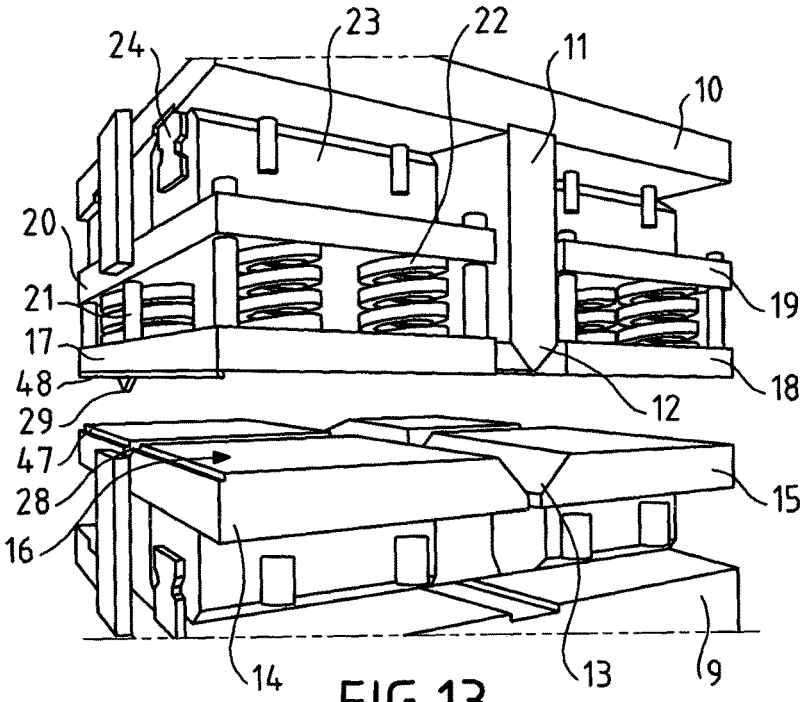

In regard to FIGS. 11, 12 and 13, one notices bending devices which make it possible to form a joggling in the area of the edges of the metal sheet 1 at the same time as the forming of the low corrugation 2 and the node zone 5.

The bending device illustrated in FIG. 11 makes it possible to form a joggling along an edge of the metal sheet 1 perpendicular to the low corrugations 2. In order to do so, the lower die has a recess 45 which extends perpendicular to the direction of the corrugation 2 being formed, along one of the edges of the lower die. In other words, the recess comprises, on the one hand, a first portion along one edge of the bearing surface 16 and the half-impression 13 of the die element 14 and a second portion along one edge of the bearing surface 16 and the half-impression 13 of the die element 15. Furthermore, the punch 11 as well as the side clamps 17, 18 each comprise a projecting portion 46 which is offset toward the bottom and designed to engage in the recess 45 of the lower die so as to form a joggling in one edge of the metal sheet 11 which is perpendicular to the corrugation 2 being formed during the movement of the side clamps 17, 18 into their clamping position and of the punch 11 into its bending position.

The bending device illustrated in FIG. 13 makes it possible to form a joggling along an edge parallel to the low corrugations 2. In order to do so, the lower die has a recess 47 extending parallel to the direction of the corrugation 2 being formed along one of the edges of the lower die. The recess 47 here is arranged along an edge of the die element 14 which is opposite the edge comprising the half-impression 13. The recess 47 is formed along the edge of the bearing surface 16 of the die element 14 and is likewise formed along an edge of the V-shaped groove 28. Furthermore, the facing side clamp 17 comprises a projecting portion 48 with a shape complementary to the recess 47 devised in the die element 14. The projecting portion 48 is formed along an edge of the side clamp 17 on its entire dimension. Thus, the projecting portion 48 is likewise devised on the edge of the male element 29 directed downward and designed to be accommodated in the groove 28 when the side clamps 17, 18 are in their clamping position.

Thus, the projecting portion 47 engages in the recess 48 devised along an edge of the die element 14 so as to form a joggling in an edge of the metal sheet 1 parallel to the corrugation 2 being formed during the movement of the side clamps 17, 18 into their clamping position.

The bending device illustrated in FIG. 12 combines the recess 45 and the projecting portion 46 perpendicular to the corrugation 2 being formed, as described in relation to FIG. 11, and the recess 47 and the projecting portion 48 parallel to the corrugation 2 being formed, as described in relation to FIG. 13. Thus, the bending device of FIG. 13 makes it possible to form a joggling along an angle of the metal sheet 1, that is, along an edge parallel to the low corrugations 2 and an edge perpendicular to the low corrugations 2.

It will thus be understood that a bending layout combining the three types of aforementioned bending devices makes it possible to form a joggling over the entire length of two perpendicular edges of a metal sheet 1, as represented in FIG. 1.

Figure 14:
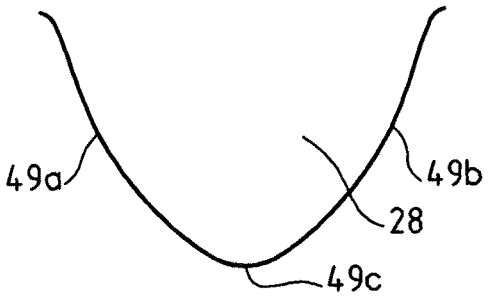
FIGS. 14 and 15 are schematic views illustrating respectively the cross section of the punch in two variant embodiments.
Figure 15:
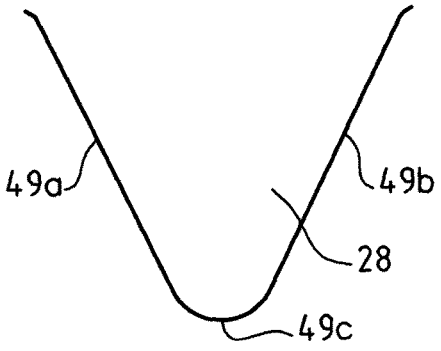

In relation to FIGS. 14 and 15, one notices the cross section of the groove 28 of the die elements 14, 15 according to two embodiments. This groove 28 has a shape complementary to that of the high corrugation 3. In these two variants, the cross section has a V shape which is defined by two lateral faces 49*a*, 49*b* meeting in the area of a ridge zone 49*c*.

The cross section illustrated in FIG. 14 essentially has a semi-elliptical shape. The two lateral portions 49*a*, 49*b* are thus curved. This shape corresponds to the final shape of the high corrugations 3. Such a shape makes it possible to confer excellent characteristics of mechanical strength on the membrane. In particular, it makes it possible to increase the resistance of the membrane to the hydrostatic pressure and to the hydrodynamic pressures generated by the "sloshing" movements of the liquid inside the tank.

The cross section illustrated in FIG. 15 has an essentially triangular shape except in the ridge zone 49*c*, which has a fillet. In other words, the two lateral faces 49*a*, 49*b* meeting in the area of the ridge zone are essentially planar. The groove 28 has such a shape during the formation of the low corrugation 2, the high corrugation 3 does not have its final shape, the latter being assumed afterwards in order to give it its final shape.

Figure 16:
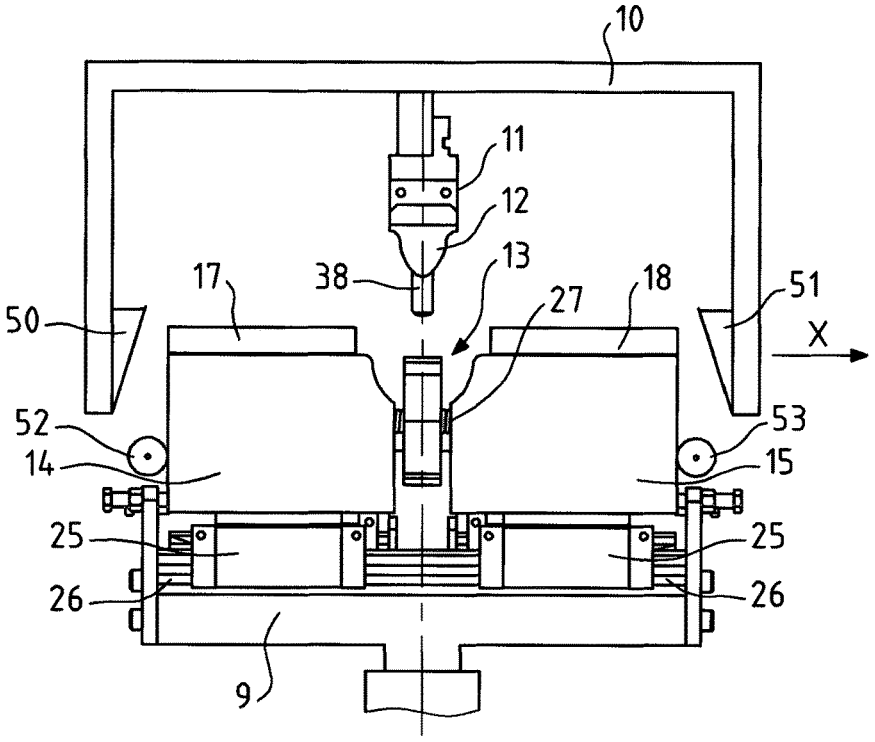
FIGS. 16 and 17 are front views of bending devices according to two other embodiments, the side clamps and the die elements being in their far position.
Figure 17:
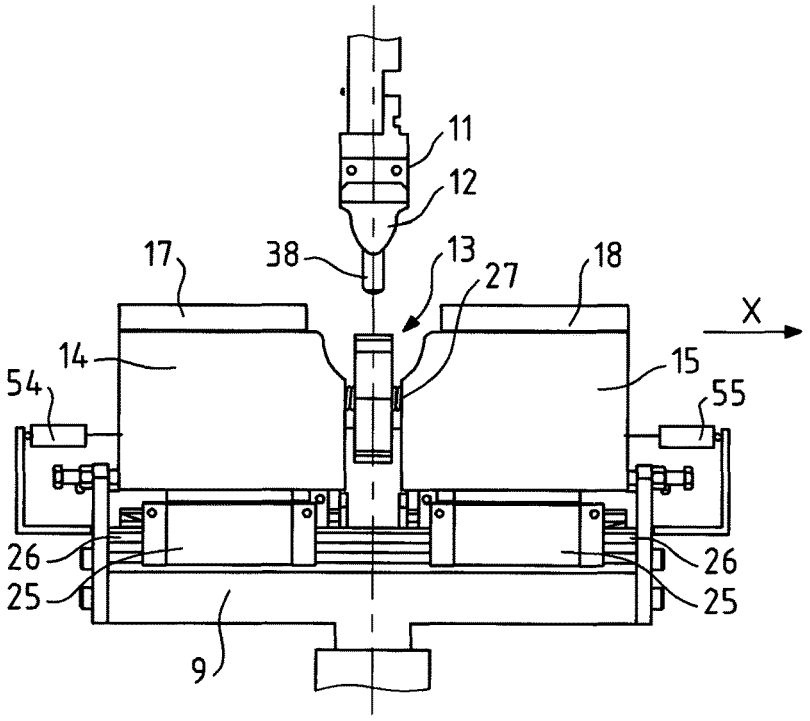

In the embodiments represented in FIGS. 16 and 17, the bending device is outfitted with means of assisting the movement of the die elements 14, 15 and the side clamps 17, 18 into their near position. Such means of assistance are particularly advantageous in that they are able to ensure in particular that the die elements 14, 15 and the side clamps 17, 18 move over their entire travel, that is, up to their final near position, during the movement of the punch 11 into its bending position.

In the embodiment of FIG. 16, the means of assistance comprise two cams 50, 51 each one cooperating with a cam follower 52, 53. Each die element 14, 15 is equipped with a cam follower 52, 53 adapted to cooperate with a respective cam surface 50, 51 borne by the upper plunger 10 when the latter moves downward from its position of rest into its bending position. The cam followers 52, 53 are advantageously pulleys mounted loosely about a horizontal axle parallel to the direction y. The cam surfaces 52, 53 are oriented such that when the upper plunger 10 moves from its position of rest into its bending position, the cam surface 52, 53 bears against the cam follower 52, 53 tending to move the die elements 14, 15 into their near position.

According to one embodiment, the cams 50, 51 and cam followers 52, 53 are arranged so that they do not come into play when the punch 11 makes contact with the portion of the metal sheet being folded, but rather afterwards during the movement of the punch 11 into its final bending position. The cams 50, 51 can also be arranged so that the cam followers 52, 53 only make contact with the cams 50, 51 in order to assist the movement of the die elements 14, 15 in the event that the kinematics of the die elements shows a slight delay in regard to the desired kinematics.

In the embodiment of FIG. 17, the means of assistance are comprised of jacks 54, 55, such as pneumatic jacks for example. The means of assistance comprise at least two jacks 54, 55 which cooperate respectively with one and the other of the two die elements 14, 15. Each jack 54, 55 has one end which is secured to the lower frame 9 and one end cooperating with one of the die elements 14, 15. Thus, the jacks are able to assist the movement of the die elements 14, 15 from their far position to their near position.

According to one embodiment, the jacks 54, 55 are traction jacks, that is, jacks able to act in a direction corresponding to a movement of retraction of their rod. In this case, the rod of each of the jacks 54, 55 passes through one of the die elements 14, 15 and cooperates with the other opposite die element 14, 15 in order to pull it into its near position.

According to an embodiment, the jacks 54, 55 are thrust jacks, that is, jacks able to act in a direction corresponding to a movement of extension of their rod. In this case, the rod of each of the jacks 54, 55 cooperates with the adjacent die element 14, 15 in order to push it into its near position.

According to another embodiment, the means of assistance comprise two pairs of jacks 54, 55 each one cooperating with one and the other of the die elements 14. In such a case, in order to balance out the forces acting on the die elements 14, the jacks of each pair 54, 55 are respectively disposed on either side of a vertical plane passing through the groove 28 of each die element. According to one embodiment, the ends of the rods of the two jacks of each pair 54, 55 are secured to an intermediate plate, not shown, which is able to cooperate with one of the die elements 14, 15 in order to push it into its near position. Thus, such an intermediate plate makes possible, on the one hand, a synchronization of the movement of the jacks of each pair and, on the other hand, a distribution of the forces acting on the die elements 14, 15 so that the forces are applied in parallel with the orientation of the guide rails 26.

According to one embodiment, not shown, the aforesaid jacks 54, 55 are associated with additional pneumatic jacks which cooperate with the side clamps 17, 18 in order to move them into their near position. In this case, the additional jacks are advantageously synchronized with the jacks 54, 55 acting on the die elements 14, 15.

Furthermore, the means of assistance can also comprise only pneumatic jacks acting on the movement of the side clamps 17, 18, although this embodiment is less advantageous.

Although the invention has been described in connection with several particular embodiments, it is obvious that it is in no way limited to these and that it encompasses all the technical equivalents of the means described, as well as their combinations, if these should fall within the scope of the invention.

It will be noted in particular that such a bending device could also be used for the formation of high corrugations in a metal plate. In such a case, the bending device could be simplified and not comprise a knife, a groove devised in the die elements, or a male element formed in the side clamps.

The use of the verb "have", "comprise", or "include" and their conjugated forms does not preclude the presence of other elements or other steps besides those mentioned in a claim. The use of the indefinite article "a" or "an" for an element or a step does not exclude the presence of a plurality of such elements or steps, unless otherwise noted.

In the claims, any reference in brackets shall not be understood as a limitation of the claim.

The invention claimed is:

1. A bending device for forming a corrugation (2) in a metal sheet (1) intended for the construction of an airtight membrane of a fluid storage tank, the bending device comprising:

a lower frame (9);

a lower die having a first and a second die element (14, 15), each having a bearing surface (16) for the metal sheet (1) and a concave half-impression, the first and second die elements (14, 15) each being mounted so as to slide on the lower frame (9) in a direction x, so as to be able to slide between a far position and a near position, the half-impressions of the first and second die elements (14, 15) together defining an impression (13) corresponding to the shape of the corrugation being formed when the first and second die elements (14, 15) are in their near position, said first and second die elements (14, 15) being returned to their far position by a first return unit (27);

an upper punch (11), arranged above the lower die, comprising a lower end provided with a head (12) having a shape complementary to that of the impression (13), said upper punch being able to move vertically with respect to the lower frame (9) between a position of rest and a bending position in which the head (12) of said upper punch (11) is engaged inside the impression (13) of the lower die so as to press on the metal sheet (1); and a first and a second side clamp (17, 18), extending on either side of the upper punch (11), above the lower die, respectively facing the first and the second die elements (14, 15), said first and second side clamps (17, 18) being mounted able to slide in the direction x between a near position and a far position and being returned to their far position by a second return unit; the first and the second side clamps (17, 18) being able to move vertically with respect to the lower frame (9) between a released position and a clamping position in which the first and the second side clamps (17, 18) are respectively brought near the bearing surface (16) of the first die element (14) and that of the second die element (15) so as to clamp the metal sheet (1) against the bearing surface of the first and the second die elements (14, 15) so that, during operation, when the metal sheet (1) is clamped between the side clamps (17, 18) and the die elements (14, 15), the displacement of the upper punch (11) from its position of rest toward its bending position causes a bending of the metal sheet (1), during which the metal sheet (1) transmits a traction force in the direction x to the die elements (14, 15) and to the side clamps (17, 18) and thus displaces the die elements (14, 15) and the side clamps (17, 18) into their near position.

2. The bending device as claimed in claim 1, for forming a corrugation (2) in a metal sheet (1) having a preformed corrugation (3) extending in a direction perpendicular to the corrugation (2) being formed; wherein the first and the second die elements (14, 15) each comprise a V-shaped groove (28) designed to receive said preformed corrugation (3).

3. The bending device as claimed in claim 2, wherein the side clamps (17, 18) each comprise a male element (29), projecting in the direction of the lower frame (9), having a V shape which is able to be introduced into the groove (28) of the die element (14, 15) facing it when the side clamps (17, 18) are in their clamping position.

4. The bending device as claimed in claim 2, wherein the head (12) of the punch (11) comprises a finger (38) projecting from the head in the direction of the lower frame (9) and disposed facing the zone of intersection between the impression (13) and the grooves (28) of the first and second die elements (14, 15).

5. The bending device as claimed in claim 2, comprising two knives (30, 31), designed for the deformation of the preformed corrugation (3), on either side of the junction between the preformed corrugation (3) and the corrugation being formed (2), the two knives (30, 31) being disposed on either side of the zone of intersection between the impression (13) and the grooves (28) of the first and second die elements (14, 15); said knives (30, 31) being mounted so as to slide on the lower frame (9) in the direction x between a far position and a near position and being returned to their far position by a third return unit (36), said knives (30, 31) being furthermore mounted able to move vertically in relation to the lower frame (9) between a low position of rest and a high bending position in which they are able to deform the preformed corrugation (3), the device furthermore comprising a driving mechanism of the knives, which is arranged to move the knives (30, 31) into their high bending position during the displacement of the punch (11) into its bending position.

6. The bending device as claimed in claim 5, wherein the driving mechanism of the knives comprises a movable support unit of the knives (35), able to move vertically on the lower frame (9), and two levers (39) which are each hinged to the lower frame (9); the levers (39) each comprising:

- a first end provided with a bearing surface, extending inside the impression (13) of the lower die and able to cooperate, during operation, with a portion of the metal sheet (1) intended to be bent to form the corrugation (2), such that the lever (39) pivots when the upper punch (11) moves into its bending position; and
- a second end cooperating with the movable support unit of the knives (35) so that the movable support unit of the knives is moved upward when the lever (39) pivots by virtue of a movement of the upper punch (11) into its bending position.

7. The bending device as claimed in claim 6, wherein the knives (30, 31) are each borne by a carriage (33) able to slide on a respective guide rail (34) and said guide rails (34) are borne by the movable support unit of the knives (35).

8. The bending device as claimed in claim 1, comprising an upper plunger (10), able to move vertically with respect to the lower frame (9); the upper punch (11) being borne by the upper plunger (10); the first and second side clamps (17, 18) being able to slide vertically on respectively a first and a second support plate (19, 20); said first and second support plates (19, 20) being able to slide in the direction x on the upper plunger (10) so as to allow the movement of the side clamps (17, 18) between their near position and their far position; each side clamp (17, 18) being furthermore moved back from its respective support plate by return units (22).

9. The bending device as claimed in claim 8, wherein the return units exerting a return force between each side clamp (17, 18) and its respective support plate (19, 20) are springs, gas jacks, hydraulic jacks, or pneumatic jacks.

10. The bending device as claimed in claim 1, wherein the lower die has a recess (45) extending in a direction perpendicular to the corrugation (2) being formed, the recess (45) extending along one edge of the bearing surface (16) and one edge of the half-impression of each of the first and second die elements (14, 15) and wherein the upper punch (11), the first and the second side clamps (17, 18) each have an edge provided with a projecting portion (46), disposed above said recess (45), complementary in shape to said recess (47) and designed to engage in said recess (45) during the movement of the upper punch (11) into its bending position and of the side clamps (17, 18) into their clamping position so as to form a joggling along one edge of the metal sheet (1) perpendicular to the corrugation (2) being formed.

11. The bending device as claimed in claim 1, wherein the lower die has a recess (47) extending in a direction parallel to the corrugation (2) being formed, the recess (47) extending along one edge of the bearing surface (16) of one of the first and second die elements (14, 15) and wherein one of the first and second side clamps (17, 18) has a projecting portion (48), disposed above said recess (47), complementary in shape to said recess (47) and designed to engage in said recess (47) during the movement of the side clamps (17, 18) into their clamping position so as to form a joggling along one edge of the metal sheet (1) parallel to the corrugation (2) being formed.

12. The bending device as claimed in claim 1, moreover comprising means of assisting the movement of the first and second die elements (14, 15) and the first and second side clamps (17, 18) into their near position.

13. The bending device as claimed in claim 12, wherein the means of assistance comprise two jacks (54, 55) cooperating respectively with one and the other of the first and second die elements (14, 15) or with the one and the other of the first and second side clamps (17, 18) and being designed to assist the movement of the die elements (14, 15) and the side clamps (17, 18) into their near position during the movement of the upper punch (11) from its position of rest into its bending position.

14. The bending device as claimed in claim 12, wherein the means of assistance comprise a first and a second cam follower (52, 53) borne respectively by the one and the other of the first and second die elements (14, 15) and respectively able to cooperate with a first and a second cam surface (50, 51) integrated with the upper punch (11); the first and the second cam followers (52, 53) and the first and the second cam surfaces (50, 51) being arranged so that during the movement of the upper punch (11) from its position of rest into its bending position the first and the second cam followers cooperate respectively with the first and the second cam surfaces to assist the movement of the die elements and the side clamps into their near position.

15. A bending layout comprising a plurality of bending devices as claimed in claim 1.

16. A method of using a bending device to form a corrugation (2) in a metal sheet (1) intended for the construction of an airtight membrane of a fluid storage tank, the bending device comprising:

- a lower frame (9);
- a lower die having a first and a second die element (14, 15), each having a bearing surface (16) for the metal sheet (1) and a concave half-impression, the first and second die elements (14, 15) each being mounted so as to slide on the lower frame (9) in a direction x, so as to be able to slide between a far position and a near position, the half-impressions of the first and second die elements (14, 15) together defining an impression (13) corresponding to the shape of the corrugation being formed when the first and second die elements (14, 15) are in their near position, said first and second die elements (14, 15) being returned to their far position by a first return unit (27);

an upper punch (11), arranged above the lower die, comprising a lower end provided with a head (12) having a shape complementary to that of the impression (13), said upper punch being able to move vertically with respect to the lower frame (9) between a position of rest and a bending position in which the head (12) of said upper punch (11) is engaged inside the impression (13) of the lower die so as to press on the metal sheet (1); and a first and a second side clamp (17, 18), extending on either side of the upper punch (11), above the lower die, respectively facing the first and the second die elements (14, 15), said first and second side clamps (17, 18) being mounted able to slide in the direction x between a near position and a far position and being returned to their far position by a second return unit; the first and the second side clamps (17, 18) being able to move vertically with respect to the lower frame (9) between a released position and a clamping position in which the first and the second side clamps (17, 18) are respectively brought near the bearing surface (16) of the first die element (14) and that of the second die element (15) so as to clamp the metal sheet (1) against the bearing surface of the first and the second die elements (14, 15);

said method involving:

the positioning of a metal sheet (1) to bear against the bearing surfaces (16) of the first and second die elements (14, 15);

the movement of the first and second side clamps (17, 18) into their clamping position in which the first and the second side clamps (17, 18) force the metal sheet (1) respectively against the bearing surface of the first die element (14) and the second die element (15);

the movement of the upper punch (11) into its bending position in which the head (12) of the upper punch (11) presses the metal sheet (1) inside the impression (13) of the lower die so as to form a corrugation (2), said movement of the upper punch from its position of rest into its bending position resulting in a bending of the metal sheet such that the metal sheet transmits a traction force in the direction x to the die elements (14, 15) and to the side clamps (17, 18) and thus moves the die elements (14, 15) and the side clamps (17, 18) into their near position.

17. Method as claimed in claim 16, wherein the metal sheet being bent has a preformed corrugation (3) and the first and the second die elements (14, 15) each comprise a V-shaped groove (28); and wherein during the positioning of the metal sheet (1) against the bearing surfaces (16) of the first and second die elements (14, 15), the preformed corrugation is engaged inside the grooves (28).

18. Method as claimed in claim 17, wherein the bending device comprises two knives (30, 31), designed for the deformation of the preformed corrugation (3), on either side of the junction between the preformed corrugation (3) and the corrugation being formed (2), the two knives (30, 31) being disposed on either side of the zone of intersection between the impression (13) and the grooves (28) of the first and second die elements (14, 15); said knives (30, 31) being mounted so as to slide on the lower frame (9) in the direction x between a far position and a near position and being returned to their far position by a third return unit (36), said knives (30, 31) being furthermore mounted able to move vertically in relation to the lower frame (9) between a low position of rest and a high bending position in which they are able to deform the preformed corrugation (3), the device furthermore comprising a driving mechanism of the knives, which is arranged to move the knives (30, 31) into their high bending position during the displacement of the punch (11) into its bending position; and wherein:

the displacement of the upper punch (11) into its bending position produces, on the one hand, a displacement of the knives (30, 31) into their high bending position and, on the other hand, a bending of the metal sheet such that the metal sheet transmits a traction force in the direction x to the knives (30, 31) and thus moves the knives (30, 31) into their near position.

* * * * *